US005377274A

United States Patent [19]

Meyer et al.

[11] Patent Number: 5,377,274

[45] Date of Patent: * Dec. 27, 1994

[54] CORRECTION CIRCUIT AND METHOD FOR IMPROVING THE TRANSIENT BEHAVIOR OF A TWO-WAY LOUDSPEAKER SYSTEM

[75] Inventors: John D. Meyer, Berkeley; Paul Kohut, Pacheco, both of Calif.

[73] Assignee: Meyer Sound Laboratories Incorporated, Berkeley, Calif.

[ * ] Notice: The portion of the term of this patent subsequent to Feb. 9, 2010 has been disclaimed.

[21] Appl. No.: 157,218

[22] Filed: Nov. 22, 1993

Related U.S. Application Data

[63] Continuation of Ser. No. 18,934, Feb. 9, 1993, abandoned, which is a continuation of Ser. No. 732,445, Jul. 18, 1991, Pat. No. 5,185,801, which is a continuation of Ser. No. 505,302, Apr. 5, 1990, abandoned, which is a continuation-in-part of Ser. No. 458,301, Dec. 28, 1989, abandoned.

[51] Int. Cl.[5] ..... H04R 29/00

[52] U.S. Cl. ..... 381/59; 381/97

[58] Field of Search ..... 381/59, 97

[56] References Cited

U.S. PATENT DOCUMENTS 4,015,089 3/1977 Ishii et al. ..... 381/99

4,769,848 9/1988 Eberbach ..... 381/97

*Primary Examiner*—Forester W. Isen

*Attorney, Agent, or Firm*—Donald L. Beeson

[57] ABSTRACT

A circuit for improving the transient behavior of a two-way loudspeaker system includes a crossover circuit with high selectivity, amplitude and phase correction circuitry for separately correcting the amplitude and phase responses of the high and low frequency drivers in their mounting environment, and correction circuitry for correcting the composite amplitude and phase response of the overall loudspeaker system after insertion of the crossover. A further phase offset technique and circuit provides for introducing frequency dependent phase shift in the loudspeaker system's high or low frequency channels for offsetting the phase responses of the high and low frequency drivers within the crossover frequency range. According to the phase offset technique of the invention, phase shift is added, preferably in the high frequency channel, until composite amplitude response curves observed on-axis and at different vertical angles off-axis are forced to be consistent. After consistency is achieved the deterioration of the amplitude response resulting from the phase offset is corrected to a flat response by means of a forced series amplitude correction circuit inserted before the crossover. The result is improved transient response off-axis as well as on-axis.

26 Claims, 9 Drawing Sheets

CORRECTION CIRCUIT AND METHOD FOR IMPROVING THE TRANSIENT BEHAVIOR OF A TWO-WAY LOUDSPEAKER SYSTEM

This is a continuation of application Ser. No. 08/018,934, filed Feb. 9, 1993, now abandoned, which is a continuation of Ser. No. 07/732,445, filed Jul. 18, 1991, now U.S. Pat. No. 5,185,801, which is a continuation of Ser. No. 07/505,302, filed Apr. 5, 1990, now abandoned, which is a continuation-in-part of Ser. No. 07/458,301, filed Dec. 28, 1989, now abandoned.

BACKGROUND OF THE INVENTION

The present invention generally relates to loudspeaker systems for sound reproduction and more particularly to a two-way or multi-way loudspeaker system.

A loudspeaker "system" as contemplated by the invention is a captive system including amplifiers, equalizers, cross-over filters, and acoustic transducers, sometimes referred to as "drivers," mounted in a speaker enclosure. The acoustical performance of such a system will be determined by the response and performance characteristics of each of its components and how each component interacts with one another. To a system designer, the goal is to have the overall system reproduce sound-as close to the original source as possible. To do this the designer must achieve good transient response, which in the frequency domain is equivalent to a relatively flat amplitude response and relatively linear phase response versus frequency across the audio frequency spectrum. The impulse response of a perfectly linear system, using linear system theory, is a delayed "delta" function which causes no distortion, but only a net delay. Further characteristics of an "ideal system" against which performance improvement can be measured are described below in the Summary of the Invention.

One limitation in loudspeaker system design centers on the physical limitations of the acoustical transducer. It is generally not possible to force a single driver to operate over the full audio frequency spectrum efficiently enough to provide high quality sound reproduction. Consequently, loudspeaker systems often employ two or more drivers of different sizes and constructions dedicated to reproducing different parts of the audio frequency spectrum. These systems are called "two-way" or "multi-way" systems depending on the number of drivers used. In a two-way loudspeaker system, the audio input signal is electronically divided by cross-over circuits into two frequency bands or channels, namely, a high frequency channel and a low frequency channel, and each channel is fed to a different driver of the system. The advantage of the two-way system is that each individual driver operates under a reduced bandwidth, allowing optimization of the driver parameters, including reduction of distortion, power handling capability, and polar pattern response. However, increased complexity make it difficult to design a two-way (or multi-way) speaker system which is a highly accurate reproducer of sound. While good transient response in a one-way speaker system generally has not heretofore been obtained, the transient response of a conventional two-way or multi-way system is inherently worse by comparison. This problem principally has to do with the fact that the sound is not being emitted from one source or superimposed sources, but rather from two or more sources separated by finite distances.

Sources of distortion within the loudspeaker system impose further limitations on the designer's ability to achieve the goal of accurate sound reproduction. Distortion, measured by comparing the system's input and the output, arises from the presence of nonlinearities in the system's phase versus frequency response and/or from the system's amplitude versus frequency response to the extent it is not flat. Viewed in the time domain, distortion causes a degradation of the system's transient response, and hence the system's ability to reproduce an audio signal with high fidelity. A major source of distortion, and principally phase distortion, in a two or multi-way loudspeaker system is introduced by the presence of the cross-over circuits. Distortion is also introduced by the loudspeaker drivers themselves, and by other sources within the loudspeaker system.

Heretofore, one of the principal methods of optimizing the response characteristics of a two-way loudspeaker system has been to optimize the cross-over circuit to improve amplitude, phase, and polar response. Cross-over filters are designed using theoretical models which assume ideal drivers that exhibit flat amplitude and linear phase response and ideal acoustic environments (cabinet enclosures). Theoretical modeling also often assumes that the two sources of sound from the two drivers sum only in terms of magnitude and phase, ignoring the sound's direction of propagation or vector characteristics. Recently more sophisticated models have been described which take into account driver amplitude variations and optimize the cross-over design for a unique driver response. In all cases, the approach has been to design cross-over circuits which exhibit minimum amplitude and phase variation versus frequency over a specific polar pattern, and to do so from theoretical models.

The problem with such theoretic modeling is that individual drivers, and loudspeaker systems in general, are far from ideal, therefore the theoretical models make poor predictors of actual response. It is not uncommon for loudspeaker systems to exhibit more than 20 dB of amplitude variation across the audio spectrum on the radiation axis. The off axis errors are more than this, and because drivers are inherently band pass transducers, they have an associated phase shift which is usually non-linear as a function of frequency. When the drivers are combined with a cross-over circuit which has its non-linear phase shift in the cross-over frequency range, the non-linear phase distortion is compounded. The harmonic distortion of the drivers are usually quite high, often in the order of several percent. Drivers are also quite inefficient as acoustical transducers, often having less than a ten percent efficiency in terms of conversion of electrical input power to acoustical output power. These and other problems produce substantial errors in theoretical models and have limited past efforts to optimize the overall response characteristics of two-way and multi-way loudspeaker systems.

The present invention provides a correction circuit and method for improving the transient response of a two-way or multi-way loudspeaker system by correcting many of the above-mentioned sources of distortion which are not addressed or accounted for in conventional optimization schemes. The invention provides a circuit and method which improves the amplitude, phase and polar responses of a two-way (or multi-way) loudspeaker system in improving the system's transient response, not at just one point, but over an acceptable region in space.

SUMMARY OF THE INVENTION

In summarizing the invention, it is useful to define the characteristics of an ideal system. Such a system would require a true anechoic and free-field environment for measurement and have the following on-axis response:

- Amplitude versus frequency: 0 dB, no variation 2 QHz to 20 kHz.
- Phase versus frequency: 0° or linear slope 20 Hz to 20 kHz.
- System would be entirely linear, i.e., no total harmonic distortion or any form of modulation distortion.
- Any response outside the audio spectrum of 20 Hz to 20 kHz must create no errors within the audio spectrum.
- Electric to acoustic power conversion efficiency: 100% for all frequencies.

The off-axis response of such an ideal system would require that all parameters of on-axis response would be met within the defined vertical and horizontal beam width of the system; outside that beam width, no energy should exist.

The improvements to the loudspeaker system's transient response provided by the invention are determined with the above ideal characteristics in mind. Deviations from these ideal characteristics are hereinafter termed "errors." Adjustments, tuning or insertion of a circuit in the signal path of the loudspeaker system which are made in order to reach this idea are called "corrections."

Briefly, the invention includes a circuit and method whereby the amplitude and phase characteristics of the individual drivers of a loudspeaker system are first corrected, and then the overall system amplitude and phase response is corrected. While a certain or gross amount of correction can be provided using fixed correction circuits designed from calculations, the invention contemplates the use of tunable elements within the circuit whereby the amplitude and phase at both the component level, i.e. the individual drivers, and then the system level can be empirically corrected during design as well as empirically fine tuned for flatness in amplitude response and linearity in phase response during the manufacturing and assembly process. In addition to the above-mentioned amplitude and phase correction, the invention also provides for introducing an intentional phase offset between the high and low frequency channels in the cross-over frequency range of the system: It has been discovered that the introduction of such a phase offset improves the transient response of a two way system off-axis as well as on-axis. That is, it improves the system's polar pattern or coverage.

The correction circuit of the invention generally will have a high frequency channel and a low frequency channel, and a crossover circuit means for dividing the frequency spectrum of an audio signal between these two channels to drive the high and low frequency drivers of the system. A tunable amplitude correction circuit means and a tunable phase correction circuit means are provided for correcting the amplitude and phase responses at both the driver and system level. Specifically, the tunable amplitude correction circuit means will provide means for individually correcting the amplitude response characteristics of the high frequency driver independently of the rest of the system; it will also preferably provide a means for individually correcting the amplitude characteristics of the low frequency driver. In each case, the amplitude response characteristics of the individual drivers are adjusted to produce a relatively flat amplitude versus frequency response over a substantial portion of the transducer's operating frequency range.

The tunable amplitude correction circuit also provides means for separately correcting the amplitude characteristics of the composite amplitude response of the loudspeaker system, that is, the overall amplitude response of the system including the crossover circuitry and correction circuitry associated with the system's high and low channels. As with amplitude correction in the system's individual drivers, amplitude correction of the composite response is provided to produce a relatively flat composite amplitude versus frequency response. Ideally it would be desirable to produce a relatively flat composite amplitude response over the entire audio frequency range.

The correction circuit of the invention also has a tunable phase correction circuit means which similarly introduces phase correction at the individual driver level and at the system level. In the case of phase correction at the driver level, it is contemplated that phase will only be corrected in the high frequency driver, and not the low frequency driver. In the low frequency ranges the phase response is not corrected because of the difficulty of economically implementing circuits for phase correction in this region and because the phase response at very low frequencies is so heavily influenced by the outside environment and is thus outside the designer's control.

The tunable phase correction means specifically permits the phase of the high frequency transducer to individually be adjusted to produce a phase versus frequency response in the high frequency channel having a relatively linear slope over a substantial portion of the driver's operating bandwidth. The phase correction circuit means further provides the ability to phase correct the composite phase response for the overall loudspeaker system by again adjusting this response to produce a phase versus frequency curve having a relatively linear slope over a substantial portion of the overall operating frequency range of the system.

One important aspect of the invention involves the manner in which phase is adjusted at the overall system level, that is, adjustment of the composite phase response. At this level, the invention provides for introducing frequency dependent phase delay within the cross-over region while introducing a relatively constant phase delay over the operating frequency range of the high frequency transducer above the cross-over frequency range. By combining such frequency dependent phase delay and constant phase delay, a composite phase response (phase shift) can be produced having a linear slope versus frequency extending from generally below the cross-over frequency range (the phase response will deteriorate somewhat at lower frequencies) through both the crossover frequency range and the remaining range of the high frequency driver.

It is noted that correction of the composite amplitude and phase characteristics of the system by means of the foregoing tunable circuits normally must be done iteratively in sequence to achieve the desired overall results. In accordance with the method of the invention, the composite amplitude response of the system is first adjusted as herein described, and then the composite phase response is adjusted. Because the adjustment in the composite phase response will affect the composite amplitude response, the amplitude response is thereafter readjusted, with subsequent readjustments of the composite phase and amplitude responses being made as required.

In a further aspect of the invention, it is contemplated that the cross-over filters will be high order circuits, preferably third order or higher, to provide relatively high roll-offs. The advantage of a higher order cross-over circuit is that the bandwidth of the cross-over frequency range is reduced, so that the region of frequency in which both drivers operate is relatively small, thereby minimizing interference. The trade off is an increase in non-linear phase within the cross-over frequency region and more total phase shift. Even though this normally results in poor group delay and transient response, this is corrected for by the correction circuit of the invention.

As above mentioned, a further important aspect of the correction circuit of the invention is a tunable phase offset circuit means for offsetting the phase of the high frequency transducer relative to the phase of the low frequency transducer within the cross-over frequency region. This forced phase offset, the degree of which, practically speaking, will vary with frequency, is introduced after correction is provided at both the driver and system level. Because introducing phase offset will affect the composite amplitude response of the system, the phase offset circuit means also includes means for correcting for the deterioration in this response by providing a tunable means for forcing the composite amplitude response back to a relatively flat response after the phase offset. The phase offset will also affect the composite phase versus frequency response of the system, however, it is found that the phase correction needed is, at least in observed instances, achieved upon carrying out the amplitude correction step. The desired result is to restore the optimized amplitude and phase characteristics previously achieved by means of the tunable amplitude and phase correction circuit means, but having a phase offset in the cross-over region for improving the system polar response.

It will be understood from the following description of the illustrated embodiment that one type of circuit can be used to implement more than one of the functions of the various circuit means of the invention at the driver or system level. In the preferred embodiment, amplitude correction at the driver level and system level are provided by parallel tunable amplitude correction circuits, such as interactively connected tunable band pass filters operatively connected after the cross-over filters in the high and low frequency channels of the circuit. Amplitude correction of the high frequency driver is achieved by tuning the amplitude correction circuit in the high frequency channel, and similarly amplitude correction in the low frequency driver is achieved by tuning the amplitude correction circuit in the low frequency channel. Correction of the composite amplitude response is achieved by tuning both of these amplitude correction circuits.

The tunable phase correction circuitry of the invention is preferably a series of cascaded all pass filters operatively connected in the high and low frequency channels of the system, preferably with a number of the all pass filters being non-tunable and having center frequencies pre-determined by doing an estimation based on measurement of the driver's phase response, and with the remainder of the all pass filters being tunable to permit the above-mentioned adjustment of the individual and composite phase responses. The phase offset provided by the tunable phase offset circuit means can also be introduced using the same type of cascaded all pass filters. In the preferred embodiment, however, the means for correcting the deterioration of the composite amplitude response of the system resulting from the phase offset is provided on the input side of the cross-over filters. The location of this amplitude correction within the system has advantages in that it forces amplitude correction in both the high and low frequency transducers simultaneously without affecting the phase offset.

The method of the invention contemplates the sequence of correction steps required to achieve the optimized amplitude and phase responses, including phase offset, which produces improved transient response over a range of radiation angles as above described. The method requires that both driver component and system response be measured by a high quality microphone, the output of which is fed to an analyzer such as a Hewlett-Packard FFT spectrum analyzer Model No. 35660A, that measurements be taken in a substantially anechoic and free-field environment, that amplitude and phase responses be adjusted at the driver and system level as dictated by the measurements, and that the phase of the high and low frequency channels be offset relative to one another in the cross-over frequency region as above-described. Preferably, all measurements, including system response measurements, will be taken on axis with the high frequency driver at approximately one-half meter, as opposed to the more conventional distance of one meter. This will reduce the effects of the environment on the measurements.

It can therefore be seen that it is a primary object of the present invention to provide a circuit and method for producing more accurate sound from a two-way or multi-way loudspeaker system as defined by the above-described ideal model for a loudspeaker. It is a further object of the invention to improve transient response within a range of radiation angles, instead of at just a single measurement point. Other objects of the invention will be evident from the following detailed description of the embodiment and the claims.

DETAILED DESCRIPTION OF THE ILLUSTRATED EMBODIMENT

Described herein are the transducers, correction circuits, a crossover circuit and cabinet geometry for a multi-way loudspeaker system; also described are methods for integrating these circuit components with reduced system errors as compared to the above-defined ideal loudspeaker system. More specifically, different forms of correction are described which, used together, reduce system error. These forms of correction fall into three general categories:

1. Transducer correction in the loudspeaker cabinet;
2. Composite system corrections at an on-axis measurement point; and
3. A phase offset to increase the beamwidth in which flat amplitude and linear phase responses are achieved.

In the first category, the described transducer correction includes the addition of constant delay to the signal of either the high or low transducer by a fixed phase correction circuit. This is done so that the acoustic centers of the high and low transducers are made to align in a plane parallel to the front panel of the speaker box. Also included is correction for flat amplitude and linear phase responses in both the individual high and low transducers. Correction is done over the transducer's operating frequency ranges and in the case of amplitude correction is done by tunable correction circuits, and in the case of phase correction by fixed phase correction circuits.

The second category of correction, the composite corrections, include inserting a crossover circuit to divide the audio signal into a high and low frequency band, correction to achieve flat composite amplitude response by a tunable amplitude correction circuit, and correction for linear composite phase response by fixed and tunable composite phase correction circuits. Because of interaction between circuits, also described is the need to iteratively repeat the amplitude and phase correction steps for the composite response.

Finally, a phase offset technique is described for providing relatively flat amplitude and linear phase responses over an increased vertical beamwidth. This phase offset technique includes introducing frequency dependent phase offset into one channel, preferably the high frequency channel, after composite corrections have been made, and providing such phase offset primarily over the crossover frequency range. The phase offset technique described includes adjusting the amount of offset to achieve consistent, that is, nearly the same, composite amplitude responses over a maximum vertical beamwidth (at this stage the composite amplitude response need not be flat), and then inserting a tunable amplitude correction circuit before the crossover circuit and using this tunable amplitude correction circuit to adjust for flat composite amplitude responses over the defined vertical beamwidth.

Transducer Corrections in a Cabinet

Figure 1:
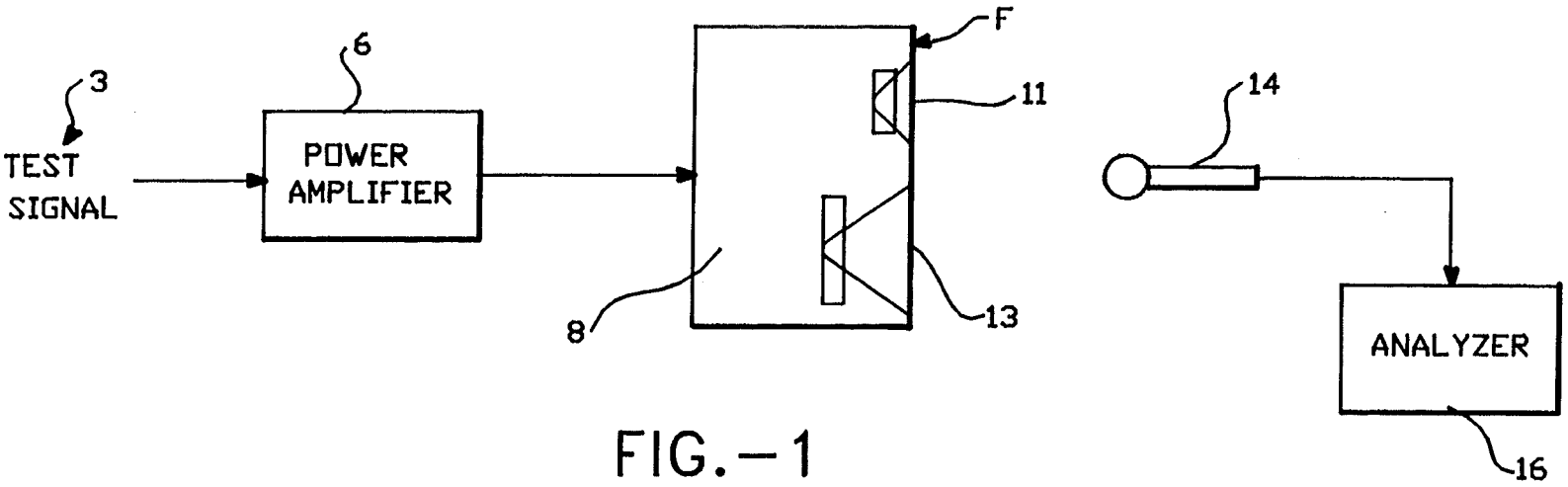
FIG. 1 is a block diagram of a measurement setup for measuring the response from the individual loudspeaker drivers corrected in accordance with the circuit and method of the invention.
Figure 7:
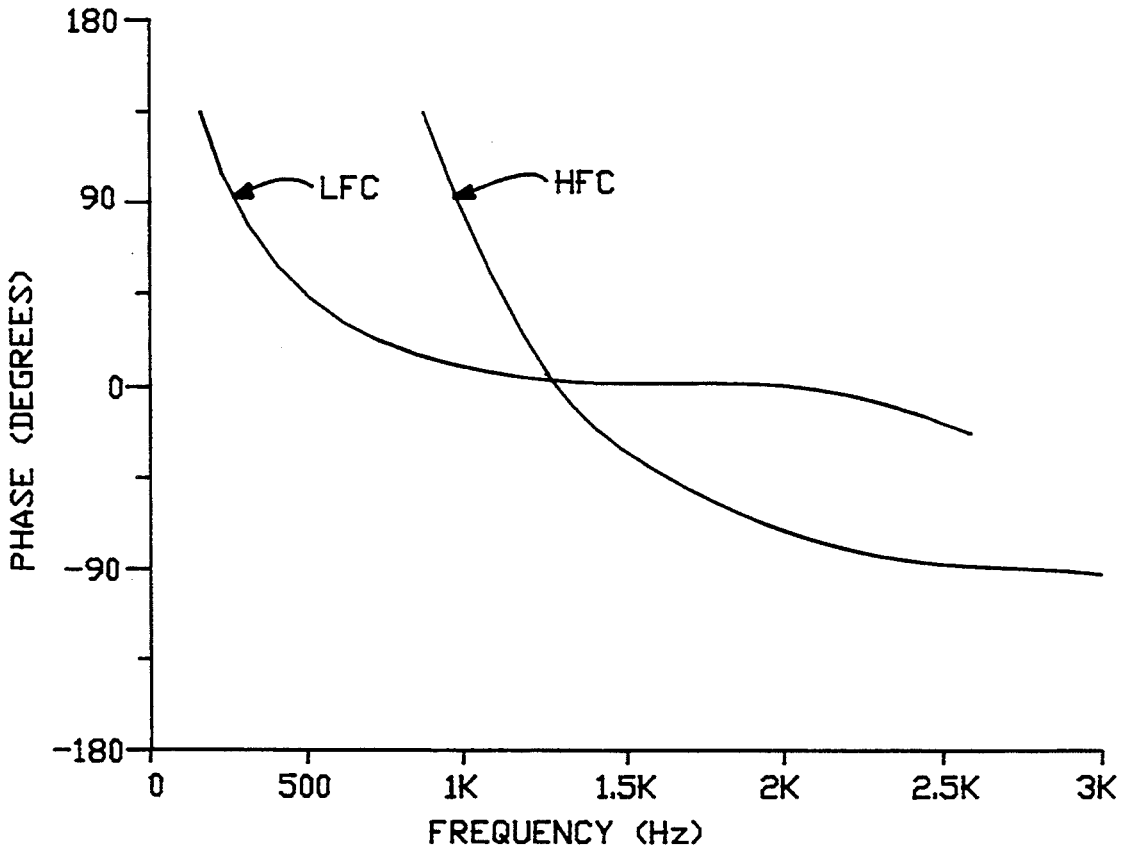
FIG. 7 is a representative plot of a phase versus frequency curve of the high and low channels of the experimental model shown in FIG. 4 after phase offset between the high and low frequency channels, which in accordance with the invention is introduced in the crossover frequency region.

Refer initially to FIGS. 1 and 7. Because the dimensions of the high and low frequency drivers 11, 13 are different, the acoustic centers of the drivers will be at different distances from the front panel F of the speaker box 8 when the drivers are mounted to the panel. To bring the acoustic centers of the drivers 11, 13 to a common plane parallel to the front panel, the signal to the driver whose acoustic center is closer to the front panel (in FIG. 1 the high frequency transducer 11) is delayed by a constant delay $\tau$ so that its equivalent acoustic center is displaced behind the front panel F at a displacement distance that puts it in the same plane as the acoustic center of the low frequency driver. The expression $\tau c$, where c is the speed of sound, represents the displacement distance. The constant delay needed to achieve this displacement distance requires a phase shift of $\Phi=2\pi f\tau$ where f equals frequency in hertz. A fixed phase shift correction circuit for achieving such phase shift can be implemented by cascading N stages of the circuit illustrated in FIG. 12 (hereinafter described), where $N=20\ \text{kHz}\cdot\tau$. Stages are cascaded because each stage in FIG. 12 can only phase shift to a maximum of $2\pi$ radians.

Figure 2:
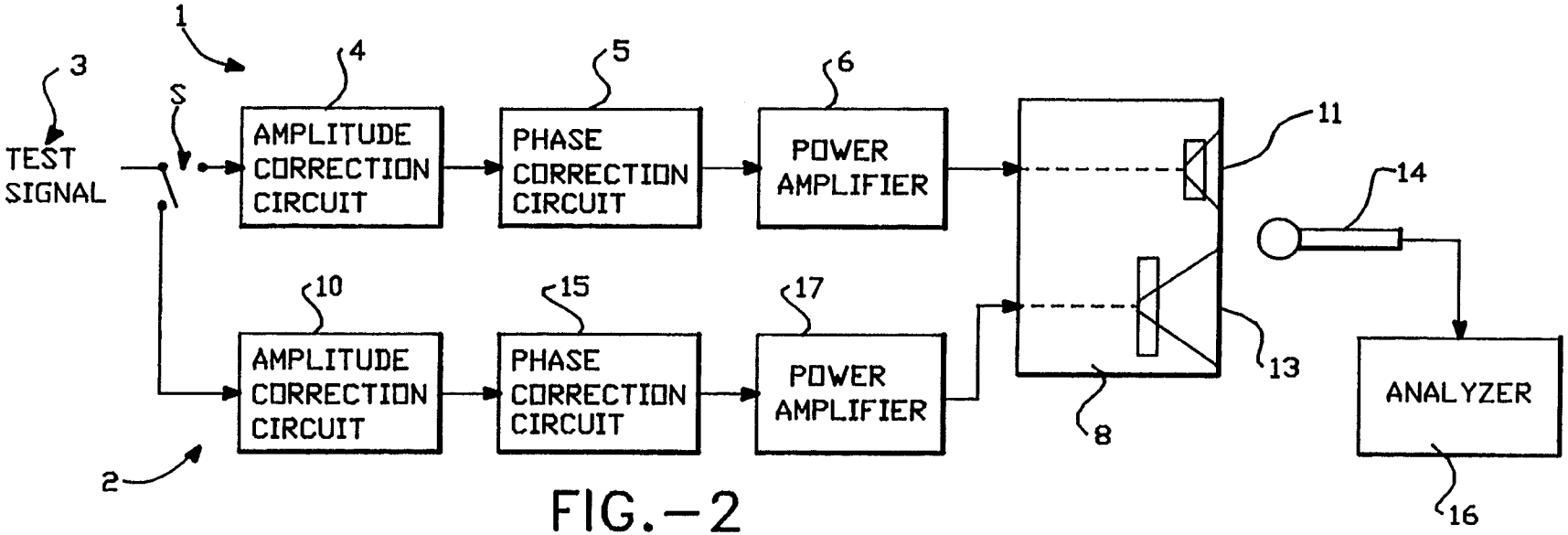
FIG. 2 is the block diagram of FIG. 1 showing the introduction of amplitude correction and phase correction in the test signal path.

FIGS. 1 and 2 show generalized measurement setups for measuring amplitude and phase errors in a loudspeaker system at the transducer level. The microphone 14 is placed at an on-axis distance of ½ meters from the high frequency transducer 11. It is noted that all measurements are made in reference to the high frequency transducer axis. This provides a single measurement reference point and provides insights to the inherent delay between the high and low frequency transducers caused by their physical separation.

To measure the amplitude and phase errors of the individual transducers 11, 13, the transducers, which are placed in the loudspeaker enclosure 8, are acoustically measured with microphone 14 and analyzer 16 by introducing a test signal 3 to the high or low signal paths 1, 2, which include power amplifiers 6, 17. The individual transducers are then corrected based on the monitored results. As shown in FIG. 2, the high frequency transducer is corrected by inserting an amplitude correction circuit 4 into the high frequency signal path (channel 1). While observing the amplitude versus frequency response of the transducer on analyzer 16, the amplitude correction circuit is adjusted to produce flat amplitude versus frequency over a substantial portion of the frequency range for which the transducer is designed and is intended to cover. After the amplitude has been corrected, the phase correction circuit 5 is introduced into the signal path for phase correction. Preferably, the phase correction circuit 5 will have already been set to an approximate phase correction through the above described calculation for aligning the acoustic centers of the transducers. This is done before insertion of the phase correction circuit 5 in the signal path. While monitoring the phase versus frequency data on the analyzer 16, the phase correction circuit 5 is adjusted to produce linear phase versus frequency on the analyzer. Similarly, as with amplitude correction, the phase characteristics of the high frequency transducer are corrected over the transducer's operating frequency range.

The above adjustment steps are repeated for the low frequency transducer through the low frequency channel 2. As shown in FIG. 2, the low frequency transducer, which is mounted in enclosure 8 directly below the high frequency transducer 11, is measured with the microphone in the same position, that is, on axis with the high frequency transducer, with the test signal being supplied to the low frequency channel through switch S. The low frequency channel 2 is provided with its own dedicated amplitude correction circuit 10, phase circuit 15, and power amplifier 17.

Each of the high and low frequency transducers 11, 13 must be corrected in their actual geometry (that is in the enclosure 8) and all measurements must be performed in a relatively reflection-free environment.

In measuring the individual transducer response, different measurement techniques can be utilized, including FFT (Fast Fourier Transform), TDS (Time Delay Spectrometry), and swept sine wave instrumentation. All of these techniques, properly used, should yield the same results when all measurement factors are taken into account.

The correction of nonlinear phase errors in high and low transducers 11, 13 is best accomplished after applying the amplitude corrections. If amplitude correction is not done first, future amplitude adjustments will disrupt the phase corrections.

It is noted that the phase responses for each of the high and low frequency transducers can be compared on the analyzer 16 since both transducers are measured by the same measurement setup as shown in FIGS. 1 and 2. In observing the phase versus frequency responses of each transducer on analyzer 16, normally several regions in the response curve will exhibit linear phase, while an overall nonlinear phase response will be observed throughout the transducer's overall operating bandwidth due to the transducers' bandpass characteristics. Preferably, phase adjustments are achieved by identifying the steepest negative slope of phase versus frequency exhibited by both the high and low frequency transducers and adjusting the phase shift of the drivers to the steepest negative slope. A phase shift of $2\pi f\tau_d$ should be the final phase response that all frequency dependent phase corrections for each individual transducer are adjusted to, where $\tau_d$ represents the steepest negative slope of the phase versus frequency responses for both drivers.

Composite Amplitude and Phase Correction

Figure 3:
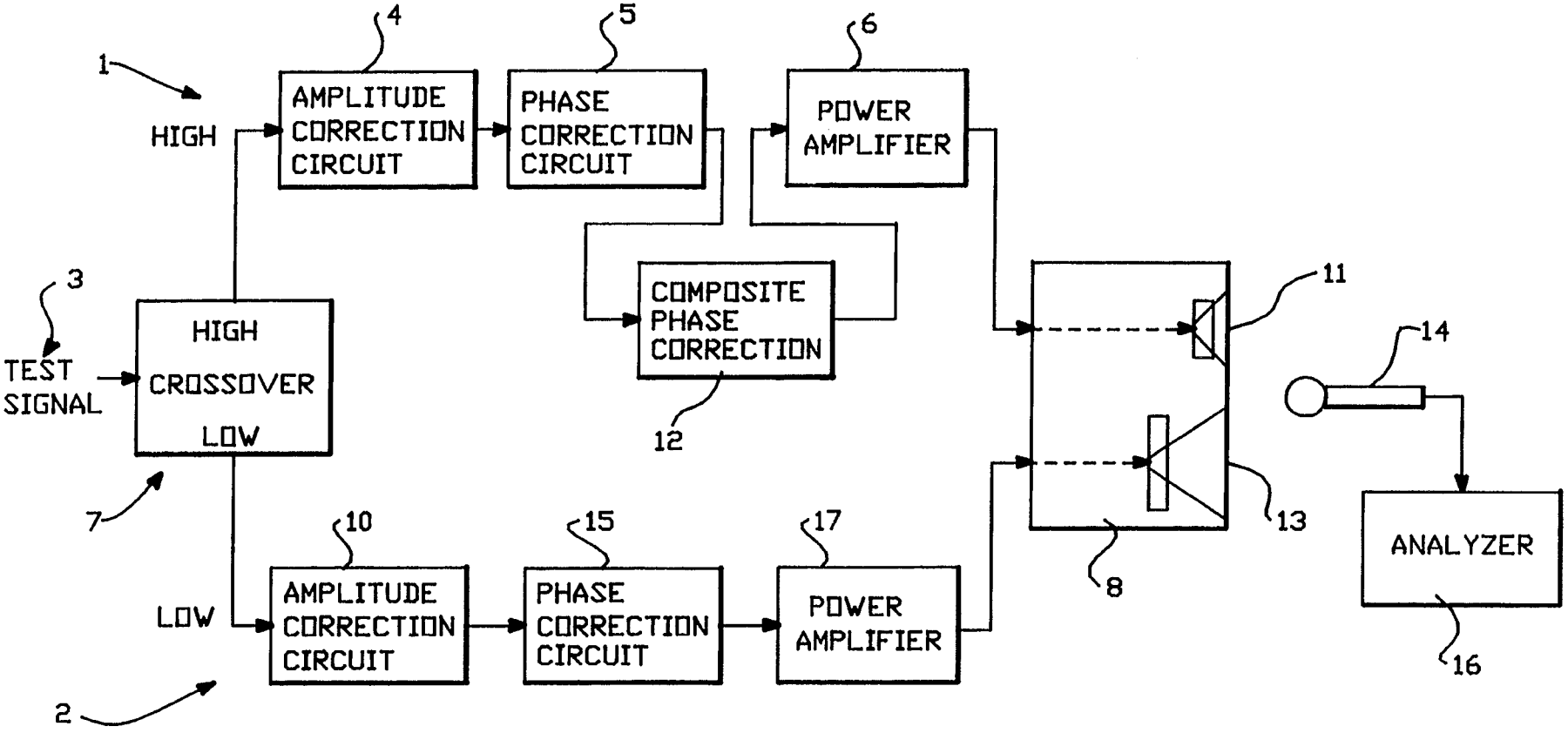
FIG. 3 is a block diagram of a measurement setup for measuring the composite amplitude and phase response of a two way loudspeaker system having amplitude and phase correction inserted in the high and low frequency channels of the system.

The second correction step of the invention includes the use of a crossover circuit with the transducers, along with more correction circuits to produce a composite flat amplitude and linear phase. With reference to FIG. 3, the transducers 11, 13, and their associated correction circuits 4,5,6,10,12,15, are combined with a crossover circuit 7. The crossover circuit 7 should exhibit high selectivity (that is a high order crossover having steep roll-off and narrow crossover range) in order to minimize interference between the transducers and harmonic distortion. The highly selective crossovers will also reduce the effective working bandwidth over which the individual drivers must operate. Highly selective crossovers, on the other hand, introduce nonlinear phase in the crossover frequency range. This, in combination with the physical separation of the transducers in the enclosure 8, produce a composite response from the loudspeaker system which, while it may be flat in amplitude, will exhibit a composite nonlinear phase response which will introduce substantial error in the acoustical output. To eliminate this error, a composite phase correction circuit 12 is introduced into the high frequency signal path 1. While monitoring the phase and amplitude response data on the analyzer 16, the composite phase correction circuit 12 is adjusted to produce linear phase throughout the audio spectrum. This adjustment of the phase will produce errors in the composite amplitude within the crossover frequency region. Therefore, the composite amplitude correction circuits 4,10 which were used to provide amplitude correction for the individual drivers as described in connection with FIGS. 1 and 2, are adjusted to correct for these resulting errors. The steps of phase correction and then amplitude correction are interactive and are therefore done iteratively until an acceptable flat composite amplitude and linear composite phase response as measured by the analyzer are achieved.

Phase Offset—Coverage Improvement

The above-described steps of individual transducer correction and composite system correction only correct for composite amplitude and phase errors in the loudspeaker system at a single chosen measurement point on the axis of the high frequency transducer 11. When the measurement microphone 14 is moved vertically over some angle, the distances from the drivers' acoustic center to the microphone change, and hence the relative phase of acoustic waves arriving at the microphone from the high and low frequency transducers also changes. Furthermore, the radiation polar patterns of the high and low frequency transducers are not the same. For a certain off-axis angle, the amplitudes of acoustic waves emitted from the high and low transducers are not in the same ratio as their on-axis magnitudes. These variations in the relative phase and amplitude of acoustic waves off-axis versus on-axis causes off-axis response errors which are most evident in the crossover frequency range where both high and low transducers contribute significantly. In other words, unless otherwise corrected using the phase offset technique described below, the vertical beamwidth where composite amplitude response is flat and composite phase response is linear, after the corrections above described, is relatively narrow.

Figure 4:
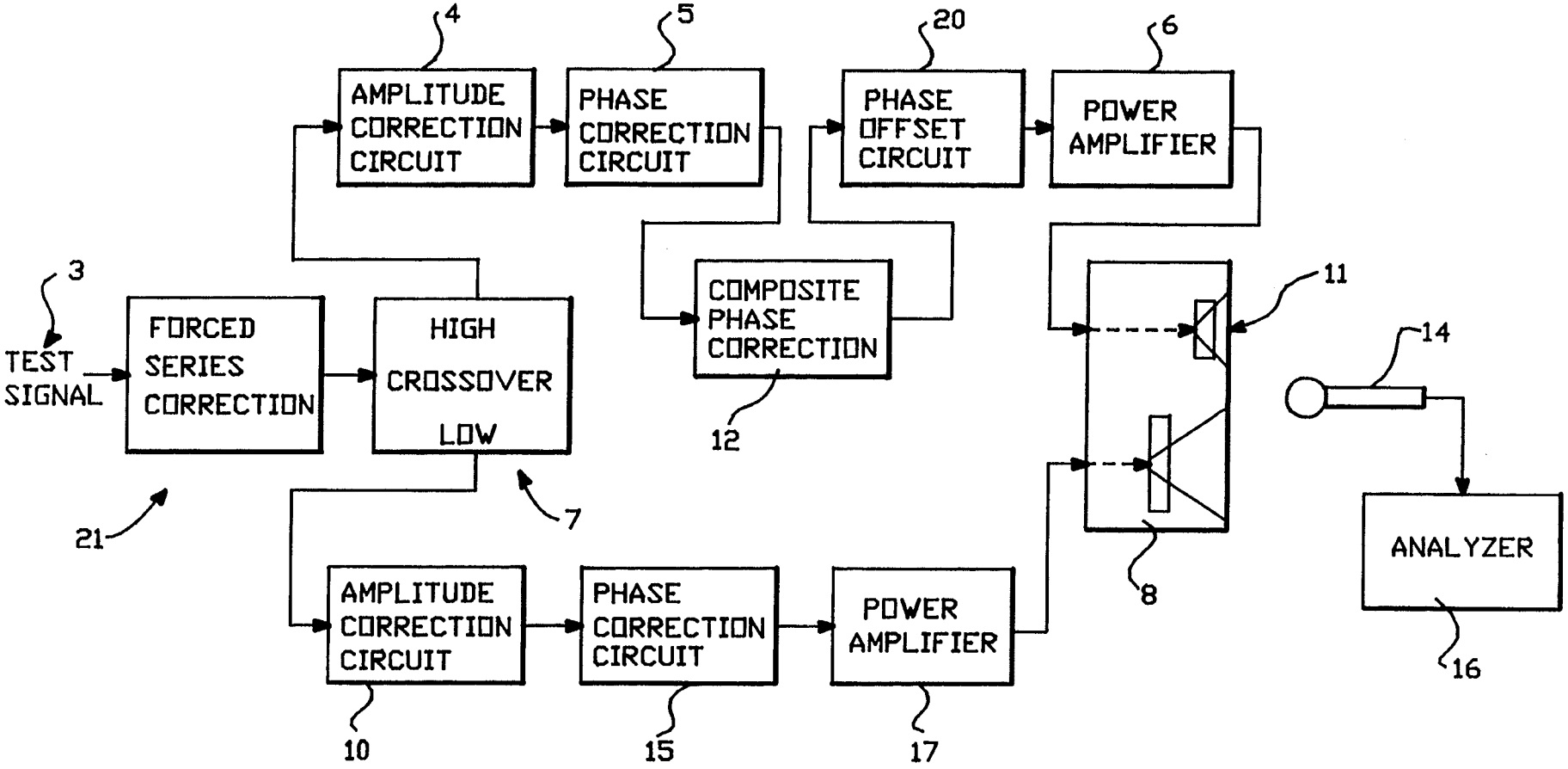
FIG. 4 is the block diagram of FIG. 3 with the addition of circuitry for introducing phase offset in the cross-over frequency region.
Figure 10:
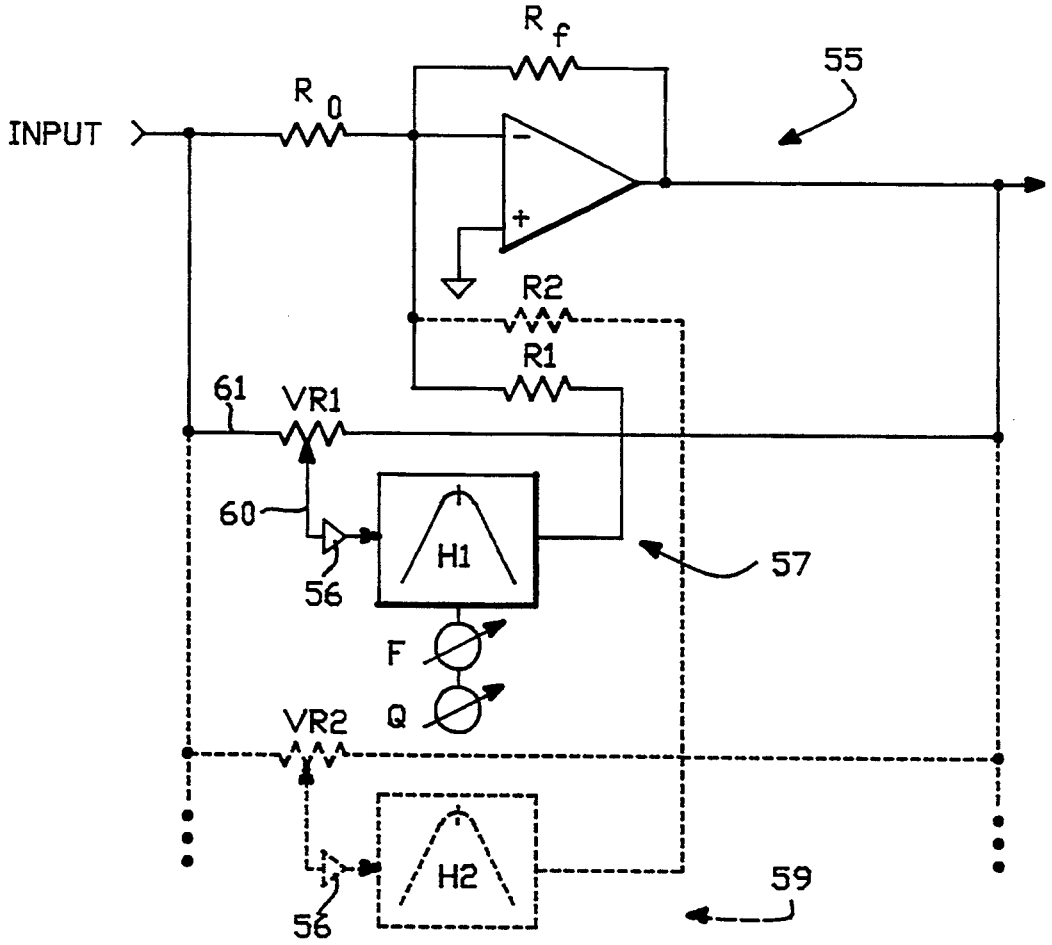
FIG. 10 is a circuit diagram of an active tunable amplitude correction circuit in accordance with the invention.
Figure 13:
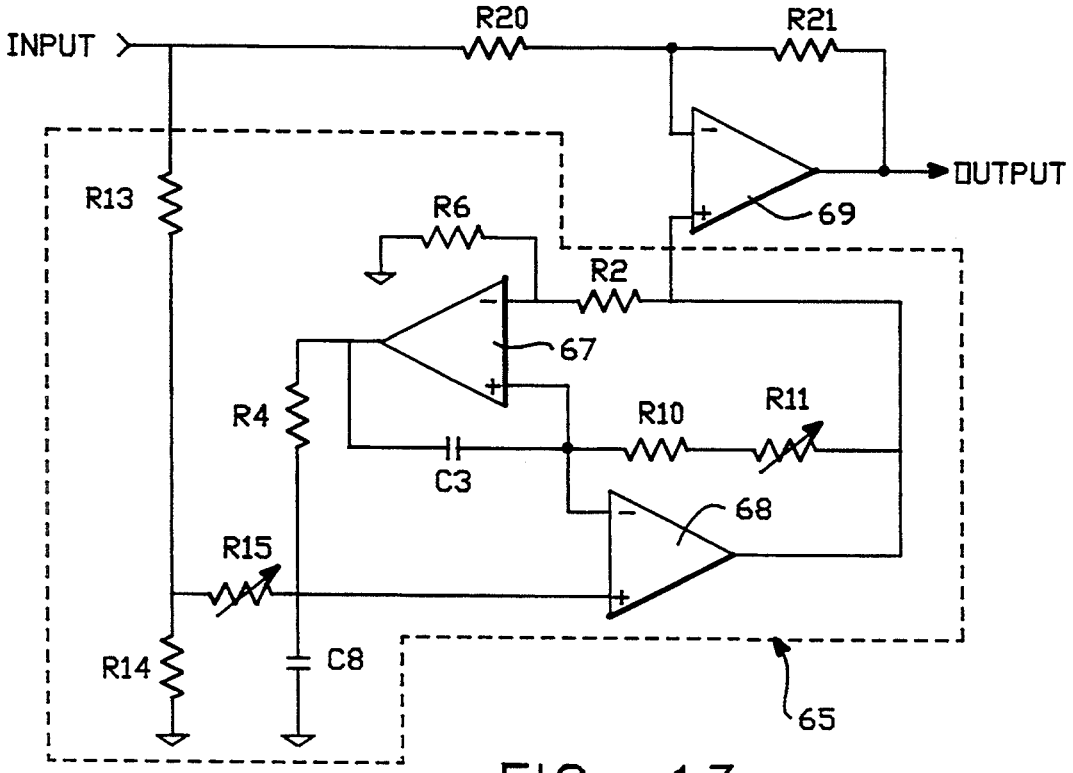
FIG. 13 is a circuit diagram of a tunable phase correction circuit in accordance with the invention.

In accordance with the invention, a composite flat amplitude and composite linear phase response is achieved over a relatively wide vertical beamwidth, for example, a beamwidth of approximately 30 degrees to above and below the on-axis response, by forcing a phase offset between the high and low frequency transducers in the crossover frequency region. Referring to FIG. 4, a phase off-set circuit 20 is inserted in the high frequency channel 1 after the composite phase correction circuit 12 to provide a means for offsetting the phase of the high frequency transducer 11 relative to the low frequency transducer 13 in the crossover frequency range. Further, a forced amplitude series correction circuit 21 is inserted in the signal path before the crossover circuit 7 to provide the amplitude correction required as a result of the phase offset introduced by circuit 20. The phase offset circuit 20 can be implemented by a tunable phase correction circuit as shown in FIG. 13 whereas the forced series amplitude correction circuit 21 can be implemented by a tunable amplitude correction circuit as shown in FIG. 10.

The phase offset technique of the invention is an imperical technique which within the system's crossover frequency range, utilizes the relatively narrow polar pattern of the low frequency driver and the relatively wide polar pattern of the high frequency driver. The procedure for adjusting the phase offset is as follows: the phase offset circuit is adjusted while observing, with the analyzer 16, the system's composite amplitude response at multiple measurement angles within a range of beam vertical angles including on-axis. Each adjustment is iteratively done until the composite amplitude responses at the different measurement angles are consistently the same. These composite amplitude responses are not necessarily flat, but should be nearly the same over a vertical beam angle as wide as can possibly be achieved.

The next step in the procedure is to adjust the forced series amplitude correction circuit 21 to flatten the aforementioned composite amplitude responses. It is found that in the course of flattening the composite amplitude responses, the composite phase response of the system, which has been distorted by introduction of the phase offset, will be linearized substantially within this wider beamwidth.

It is noted that the above adjustments to achieve the phase offset are made over a crossover frequency range where the composite responses of the loudspeaker system is the sum of the high and low frequency channels 1 and 2 of the system. Outside the crossover frequency range, the already corrected individual response of either the high and low frequency transducer will dominate.

Theory of Phase Offset Technique

The explanation of why the above described phase offset technique produces improved response characteristics of a two-way or multi-way loudspeaker system over a wider vertical beamwidth is, it is believed, directly related to the characteristics of the polar patterns of the high and low frequency transducers. Within the crossover frequency range, the high frequency transducer, as above mentioned, has a wider beam pattern than the low frequency transducer. While the system's on-axis composite response within the crossover frequency range is contributed substantially equally from the high and low frequency transducers, the off-axis high angle composite response tends to be dominated by the high frequency driver over the low driver because of its wider coverage. Generally, the characteristics of the high and low frequency drivers is that they exhibit a flatter amplitude response on-axis than they do off-axis. Correspondingly, the composite amplitude response of both the drivers without phase offset tends to exhibit the same property, that is, that the on-axis amplitude frequency response of the composite is flatter than the off-axis response.

It is believed that the introduction of phase offset in the crossover frequency range will cause a forced degradation in the amplitude response on-axis where the high and low frequency drivers are contributing substantially equally to the composite response, while off-axis the phase offset will have a less significant effect. Thus, using a phase offset the composite amplitude response on-axis can be made to change relative to the composite amplitude response off-axis. By adjusting the degree of phase offset, the amplitude responses on and off-axis can be made to look substantially the same. Once forced consistency between amplitude responses over a maximum vertical beam angle is achieved, the resulting consistent and non-flat composite response can be corrected by the forced series amplitude correction. Since it acts on both channels equally, series correction will force the return to a flat amplitude response both on and off-axis. The actual amount of phase offset and forced series amplitude correction is dependent on the crossover frequency range, the polar patterns of the drivers within the crossover frequency range, and the distance between the acoustical centers of the drivers.

Experimental Model

Figure 6:
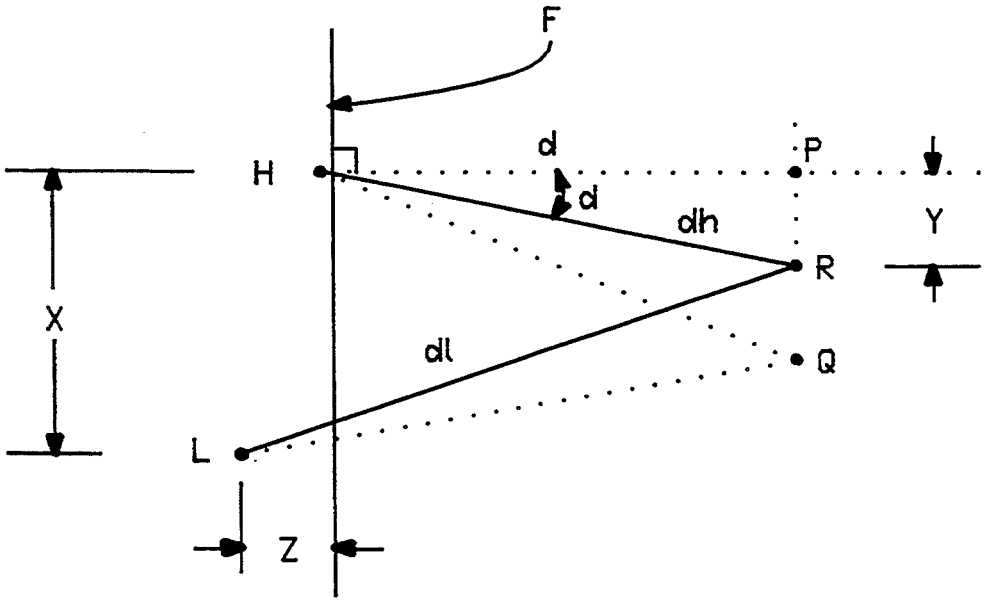
FIG. 6 shows a geometric model of sound radiation of the two way loudspeaker system illustrated in FIG. 1.

FIG. 6 provides a geometric model of a two-way loudspeaker system illustrating the radiation of acoustical energy to two off-axis measuring points R and Q from two acoustic centers H and L separated by a distance x. The acoustic centers H and L correspond to the acoustic centers for, respectively, the high frequency and low frequency drivers 11, 13 in FIG. 1. It is noted that the acoustic center for the high frequency driver H is located almost at the baffle surface F of the speaker enclosure whereas, due to the physical differences between the drivers discussed above, the acoustic center L for the low frequency driver is located at a distance Z behind the baffle surface. When the response characteristics of the loudspeaker at the driver level and at the composite system level are measured on-axis as above described, the response is measured at the measurement point P at a distance d from and on-axis with the acoustic center H of the high frequency driver. As above mentioned, d is preferably one-half meter.

When measuring a composite amplitude response off-axis during the phase offset procedure above described, amplitude response is not only measured at the on-axis measuring point P, but also the off-axis measuring points R and Q which are also located at a distance d from the baffle surface T, but which, as illustrated, are at different distances from acoustical centers H and L. For example, when the measurement point is moved from the on-axis measurement point P to the off-axis measurement point R by vertical distance of y (or at an angular displacement $\alpha$) the distance from acoustical centers H and L are, respectively, $d_h$, and $d_l$.

To illustrate the results of the phase offset technique on an experimental geometry, reference is made to FIG. 7 of the drawings. Shown in FIG. 7 are representative phase versus frequency graphs of the high and low channels of a two-way loudspeaker system having a 1" dome tweeter and an 8" cone woofer separated by 6¾", in an enclosure measuring 16" high and 12" wide. The phase versus frequency curve marked "LFC" in FIG. 7 is the phase response of the low frequency channel of the loudspeaker system and the curve marked "HFC" is the phase versus frequency response of the high frequency channel after phase offset has been introduced into the channel. It is noted that the two curves have a variable phase offset within the crossover region around a crossover center frequency of 1.4 kHz, where both transducers substantially contribute to the composite response from the loudspeaker. The relative phase differences outside the crossover region are of little importance since outside the crossover region either one or the other of the transducers dominants.

Implementation Circuits

The circuits described herein are functionally used for crossover, phase correction, amplitude correction, and power amplification. Such circuits are generally well-known and commonly accessible. However, the present invention utilizes particular kinds of circuits with the following features:

(a) Crossover: third order in high pass, fourth order in low pass, which is easy to design.

(b) Amplitude correction circuit: bandpass filter is adjustable in center frequency and bandwidth independently by single variable resistors. The amount of amplitude correction produced is a function of an interaction of the bandpass filters in a ratio of sums form rather than a product form.

(c) Phase correction circuit: a fixed phase correction circuit with a low component count is utilized. Tunable phase correction is provided which is adjustable in center frequency and Q independently by single variable resistors. Total phase correction is a sum of the phase corrections of each stage of the circuit.

Figure 8:
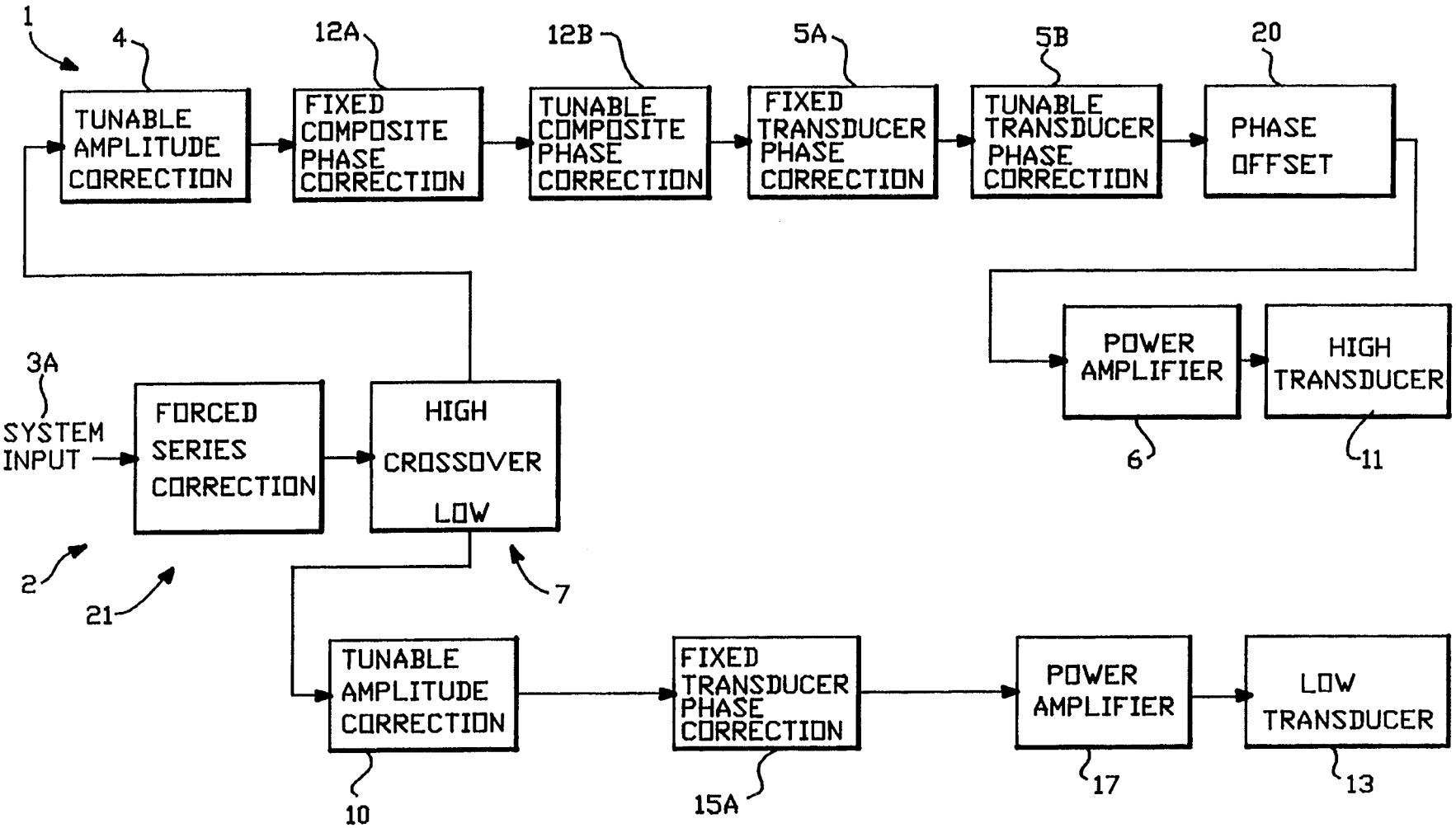
FIG. 8 is a functional block diagram of a loudspeaker system having correction circuitry in accordance with the invention.

The system integration starts with unrelated amplitude and phase responses of the transducers 11 and 13. The circuit means to combine such two coarse responses into an ideal one must be easy to adjust for the fine tuning of the system's response. Independent center frequency and bandwidth (hence Q) controls for phase and amplitude correction reduce the complexity and difficulty in adjustment and design needed to integrate the components of a multi-way loudspeaker system for achieving ideal responses. The interaction of bandpass filters in the amplitude correction circuit in a ratio mode makes amplitude correction easier because a linear potentiometer can vary amplitude proportionally in decibels. Amplitude correction is also easier because the interaction of bandpass filters in the summation mode is more similar to the summation of acoustic waves in a reflective environment. Referring to FIG. 8, the invention involves the combination of functionally specific circuits, that are connected to correct the amplitude and phase errors of a loudspeaker system as above described. The functional block diagram of FIG. 8 utilizes arrows to each block indicating circuit input and output, and signal flow. The functional circuits, extending from system input 3A through the power amplifiers 6, 17, are considered active, that is, requiring power supplies for operation. Furthermore, circuit diagrams shown in FIG. 9 through 13 and hereinafter described assume operational amplifiers of reasonable performance connected to power supplies as recommended by manufacturers. In most cases the blocks in FIG. 8 except power amplifiers and transducers are formed by operational amplifiers and resistors and capacitors. Because of high input and low output impedances of operational amplifiers, the FIG. 8 blocks are independent of each other such that interactions between them are negligible. This not only allows clear functional definition and design of each block, it also permits changes of connection sequences of these blocks if a group of blocks are connected in single series without branches. Therefore, in the high frequency channel 1, blocks 4, 12A, 12B, 5A, 5B, 20 can be connected in any other sequences; similarly, blocks 10, 15 in the low frequency channel 2 can be exchanged in position. Furthermore, each block is composed of cascaded circuits dividable into stages formed around operational amplifiers. These stages, such as all pass and bandpass filters, are exchangeable in their cascaded or parallel positions.

After experimentation, several amplitude or phase correction stages in different sections can be combined into fewer stages with the same total amount of correction. This is because of the ideal isolation property of active filters using operational amplifiers.

Crossover circuit

The crossover circuit 7 shown in the drawings functionally divides the audio spectrum of the system audio input into two bands, a low frequency and high frequency band. The crossover circuit for performing this function, shown in FIG. 9, comprises four sections, a primary highpass filter 31, a secondary highpass filter 32, a primary lowpass filter 33, and a secondary lowpass filter 34.

Figure 9:
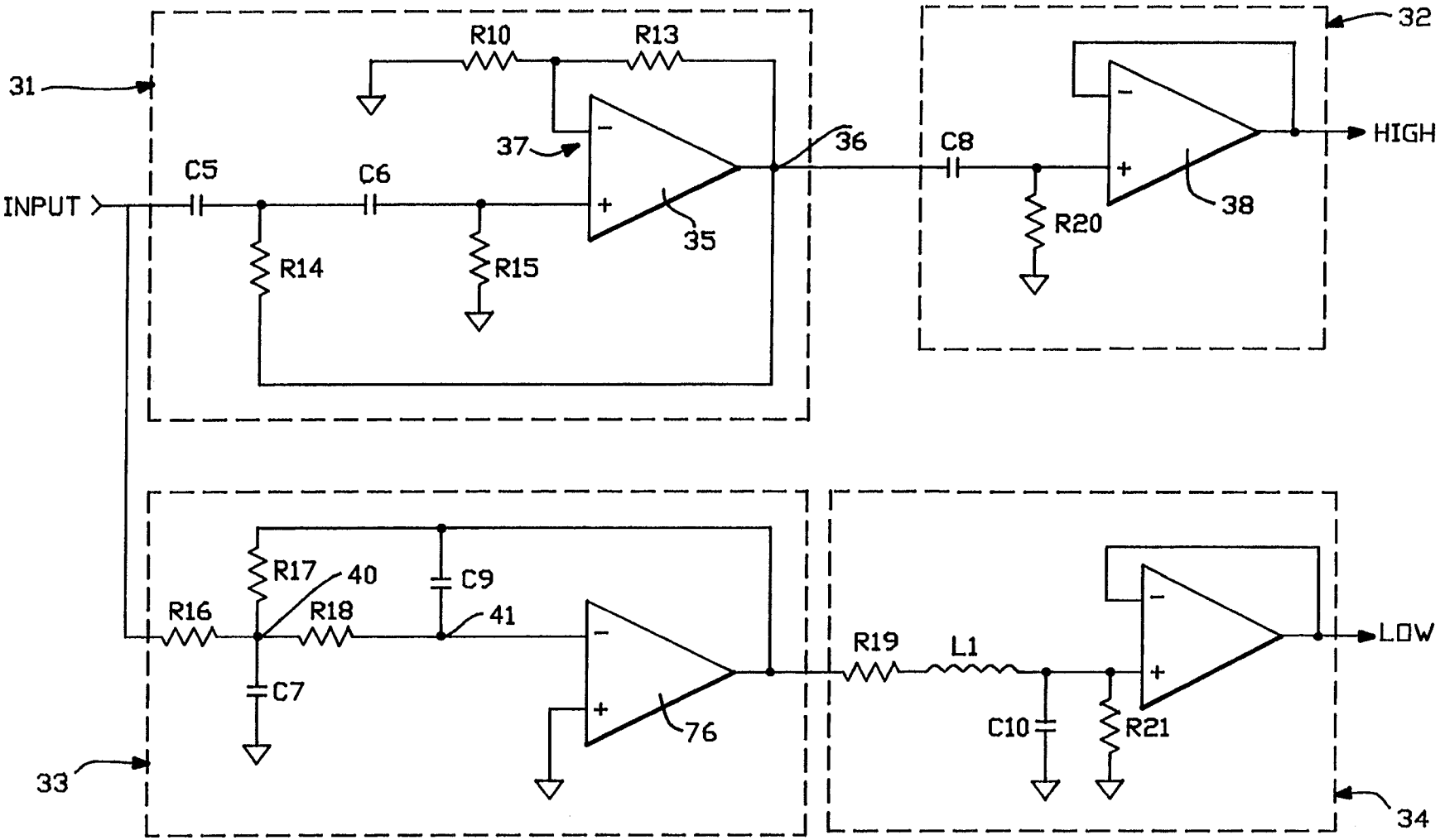
FIG. 9 is a circuit diagram of a crossover circuit as used in the system of the invention.

The primary high pass filter 31 in FIG. 9 is a second order Sallen-Key high pass filter which is a variation of two cascaded RC sections $C_5R_{14}$, $C_6R_{15}$ with feedback from the output 36 to the input 37 of operational amplifier 35 through resistor $R_{14}$. The two cascaded RC sections $C_5R_{14}$, $C_6R_{15}$ form a basic passive second order high pass filter. The feedback from the operational amplifier's output 36 controls the coefficient of the first order term of the Laplace complex variable, S, in the denominator of the transfer function of filter 31 given below, and hence bolsters the response near the cutoff frequency to achieve the desired damping and shape. The transfer function for the primary high pass filter 31 is:

$$\frac{V_{out}}{V_{\epsilon}} = \frac{\left(\frac{R_{10}+R_{13}}{R_{10}}\right)S^2}{S^2 + \left[\frac{1}{C_5R_{15}} + \frac{1}{C_6R_{15}} + \frac{1-\left(\frac{R_{10}+R_{13}}{R_{10}}\right)}{C_5R_{14}}\right]S + \frac{1}{R_{14}R_{15}C_5C_6}}$$

This high pass filter has a gain of $$\frac{(R_{10}+R_{13})}{R_{10}}$$

in the passband, determined by resistors $R_{10}R_{13}$ connected from the operational amplifier's output 36 to its negative input and to ground in a standard non-inverting gain scheme. This gain also appears in the coefficient expression of S in the denominator of the transfer function shown above by feedback through resistor $R_{14}$. This reduces the coefficient of S and hence increases the Q of the high pass filter, boosting the filter's response near cutoff frequency causing sharper transition from passband to roll-off. Because it is second order, filter section 31 produces −12 dB per octave roll-off in its stopband.

The primary lowpass filter section 33 is a second order infinite gain multiple feedback filter in the lowpass mode by using capacitor $C_9$ in the feedback path and capacitor $C_7$ after resistor $R_{16}$ around operational amplifier 76. This kind of filter is operated in the infinite gain mode with feedback paths through resistor $R_{17}$ and capacitor $C_9$. By equating currents at nodes 40, 41, respectively, in FIG. 9, the transfer function of the primary low pass filter can be expressed as $$\frac{V_{out}}{V_\epsilon} = \frac{-\left(\frac{1}{R_{16}}\right)\left(\frac{1}{R_{18}}\right)}{(SC_9)\left(\frac{1}{R_{16}} + SC_7 + \frac{1}{R_{18}} + \frac{1}{R_{17}}\right) + \frac{1}{R_{18}}\frac{1}{R_{17}}}$$

The secondary high pass filter 32 is a RC first order passive high pass filter $C_8$, $R_{20}$ followed by a non-inverting unity gain operational amplifier buffer 38. The passive RC filter $C_8$, $R_{20}$ is connected to the low-impedance output 36 of the operational amplifier 35 of preceding high pass filter 31 and to the high impedance input of a buffer (not shown) after it. Hence the secondary high pass filter 32 isolates itself from loading to perform exactly as an RC high pass filter. The transfer function which determines the response of, the secondary high-pass filter is:

$$\frac{V_{OUT}}{V_\epsilon} = \frac{R_{20}}{\frac{1}{SC_8} + R_{20}}$$

The secondary low pass filter 34 is a RLC second order passive filter formed by $R_{19}$, $L_1$, $C_{10}$ and $R_{21}$. Similar to filter circuit 33, circuit 34 is preceded and buffered by operational amplifiers to remove loading from other circuits, allowing filter circuit 34 to precisely function as low pass filter designed with component values. The transfer function which determines the response of the secondary lowpass filter is:

$$\frac{V_{OUT}}{V_\epsilon} = \frac{1}{(R_{19} + SL_1)\left(SC_{10} + \frac{1}{R_{21}}\right) + 1}$$

With the component values on FIG. 9 shown below, filters 31 and 33 has a −3 dB crossover frequency of 1.4 kHz. The high pass filters 31 and 32 are third order together, producing −18 dB per octave roll-off in the stopband. The low pass filters 33 and 34 are fourth order together, producing −24 dB per octave roll-off in the stopband. The −3 dB crossover frequency is chosen by matching the amplitude responses of the high and low transducers. The high roll off rate is designed to minimize interactions between the high and low channels and to reduce harmonic distortion.

The following component values achieve the below stated results:

| | | |
|---|---|---|
| C5 - 8200 pf | R10 - 28.7 k | $L_1$ - 252.5 mh |
| C6 - 8200 pf | R14 - 11 k | |
| C7 - .033 pf | R15 - 18.2 k | |
| C8 - 0.08 uf | R16 - 10 k | |
| C9 - 6800 pf | R17 - 10 k | |
| C10 - .12 pf | R18 - 6.81 k | |
| | R19 - 2.1 | |
| | R20 - 1 k | |

-continued

| |
|---|
| R21 - 1 k |

Tunable Amplitude Correction Circuits

Figure 11:
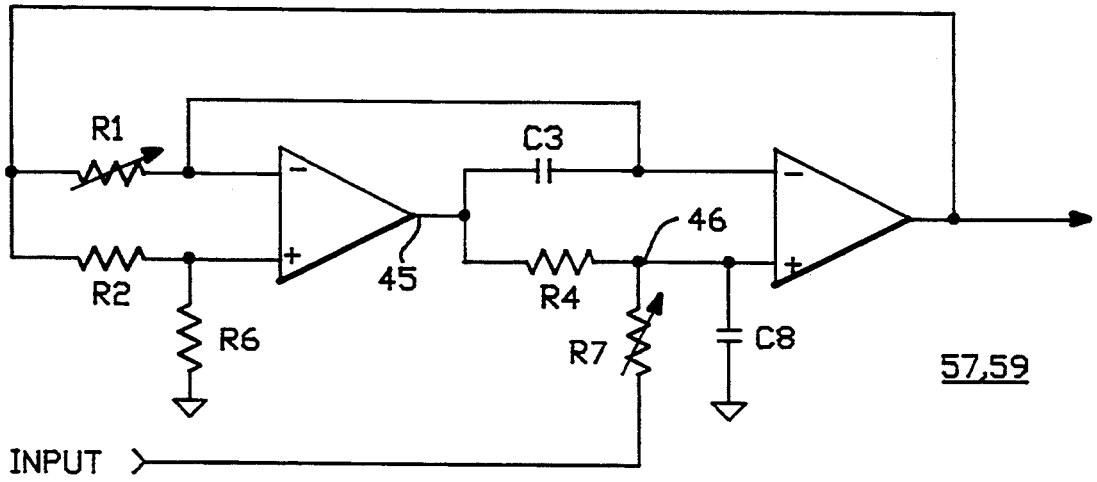
FIG. 11 is a circuit diagram of the tunable band pass filter subcircuit of the circuit shown in FIG. 10.

Referring further to FIG. 8, the tunable amplitude correction circuits 4, 10 in the high and low signal paths 1 and 2, and the forced series correction circuit 21 can have the same circuit topology. This topology, shown in FIGS. 10 and 11, is comprised of an inverting summation amplifier 55, and associated multiple bandpass filters 57, 59 (shown in greater detail in FIG. 11) which can be extended to n bandpass filters. Using the notations in FIG. 10, the transfer function of the tunable amplitude correction circuit is $$\frac{V_{out}}{V_\epsilon} = \frac{-\left[\frac{R_f}{R_o} + \sum_{i=1}^{n} \frac{R_f}{R_i} * (1 - \theta_i)H_i(s)\right]}{1 + \sum_{i=1}^{n} \frac{R_f}{R_i} * \theta_i * H_i(s)}$$

where $H_i(s)$ is the transfer function of the bandpass filter subcircuits 57, 59, . . . etc.; and $\theta_i$=percentage of resistance from the tap 60 to the input side 61 of variable resistors VR1, VR2, etc.

The above transfer function has the bandpass filters in an interactive mode such that the response of the transfer function is the ratio of summations of complements of the transfer functions of the individual bandpass filters 57, 59. The tuning needed to adjust the amplitude correction is achieved by varying variable resistors $VR_i$: 100% $\theta_i$ means full extent of dip and 0% $\theta_i$ means full extent of bump. Thus, variable resistors $VR_i$ determine the amount of dip or bump for bandpass filter subcircuit $H_i(s)$ shown in FIG. 11. The resistors $R_i$, $R_o$, $R_f$ and operational amplifier 55 are in a standard inverting summing scheme. Buffers 56 are necessary to isolate bandpass filter subcircuits $H_i(s)$ from loading the variable resistors VR1, VR2.

The structure of FIG. 10 can be cascaded to provide amplitude correction over wider frequency ranges. The ideal number of bandpass filters in the FIG. 10 circuit is dependent on the bandwidth, location and amount of transducer amplitude error encountered and the degree of accuracy desired. It has been found that corrections to ±1.5 dB with high frequency resolution yields good results for the overall system corrections. This has required five bandpass filters in the high frequency channel and three in the low frequency channel.

FIG. 11 shows the circuit structure of the bandpass filter subcircuits 57, 59 in FIG. 10 where there are second order bandpass circuits. These circuits excluding $R_7$ and $C_8$, convert $C_3$ into an equivalent inductor of value $$\frac{R_1R_4R_6C_3}{R_2}$$

at node 45 by (1) forcing a circuit of amplitude $$\frac{R_2}{R_1R_6} V_A$$

through $C_3$, (2) developing a voltage drop $$\frac{R_2}{R_1R_6} V_A \frac{1}{SC_3}$$

over $C_3$, and (3) converting voltage drop across $C_3$ into a current $$\frac{R_2V_A}{R_4R_1R_6} \frac{1}{SC_3}$$

through $R_4$, where $V_A$ is the voltage at node 46. The equivalent inductance at node 45 in parallel with $C_8$ forms a resonant circuit in series with $R_7$. The center frequency of 57, 59 is determined by $$fc = \left(\sqrt{\frac{R_2}{R_1R_4R_6C_3C_8}}\right)/2\pi$$

which is preferably adjustable by $R_2$, $R_6$, $R_1$ or $R_7$. $R_1$ is chosen here for center frequency adjustment. The bandwidth of this simulated RLC resonant circuit is $$BW_{(Hz)} = \frac{1}{2\pi R_7C_8}$$

which is adjustable by varying $R_7$. Both $f_c$ and BW can be independently adjusted by varying single resistors $R_1$, $R_7$. Center frequency or bandwidth errors because of component value tolerances are easily compensated by varying $R_1$ or $R_7$. This circuit also has a gain of $$\text{Gain} = 1 + \frac{R_2}{R_6}$$

Fixed Phase Correction Circuit

Referring again to FIG. 8, blocks 15, 5A, 12A are fixed phase correction circuits providing gross phase shift to correct the nonlinear phase errors in the individual transducers 11, 13 in the high or low frequency channels 1, 2. Such circuit in general is in "allpass" filter form which has the following transfer function:

$$\frac{V_{OUT}}{V_\epsilon} = \frac{S^2 - \alpha\omega_0 s + \omega^{20}}{S^2 + \alpha\omega_0 s + \omega^{20}}$$

where $\theta_o$ is the center frequency and $\alpha$ is the damping factor, 1/Q.

Figure 5:
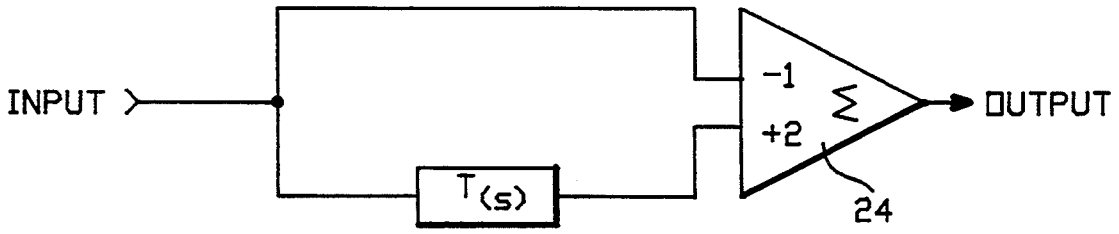
FIG. 5 is a block diagram showing the function of an "all pass circuit."
Figure 12:
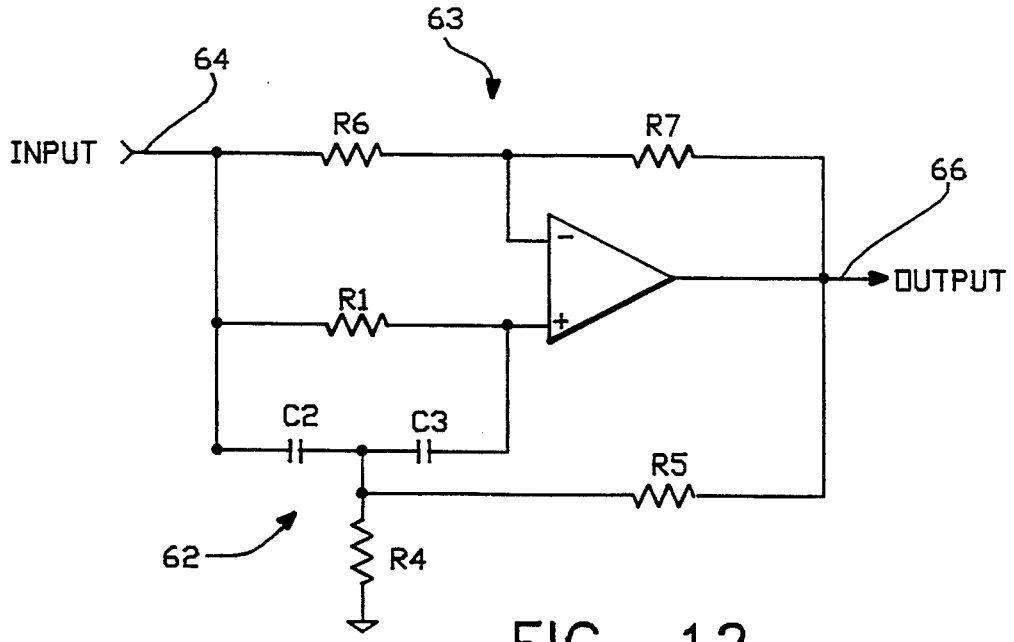
FIG. 12 is a circuit diagram of a circuit for introducing predetermined fixed phase correction to a loudspeaker system corrected in accordance with the invention.

The general implementation of such allpass filters is shown in FIG. 5 where a differential summer 24 converts a bandpass function T(s) into 2T(s)−1 which is allpass. In FIG. 12 a specific circuit which is a variation of the general allpass filter form in FIG. 5 is used for fixed phase correction because of its low component count and interactive tuning. Resistors $R_6$, $R_7$ set the inverting gain of the operational amplifier 63 which acts as a differential amplifier. A bridge "T" filter 62 composed of resistors and capacitors $R_1$, $C_2$, $C_3$, $R_4$, $R_5$ ties the input 64 to the operational amplifier 63 and also provides a positive feedback from the output 66 of the operational amplifier 63 through voltage divider $R_5$, $R_4$.

The equations for choosing the values in this circuit are:

$$R_p = R_4 \| R_5 \quad \omega_o = \sqrt{\frac{1}{R_1C_2C_3R_p}}$$

$$Q = \frac{\omega_0}{\left(\frac{1}{R_pC_2}\right)\left(\frac{R_7}{R_6}\right) - \left(\frac{1}{R_1C_2}\right) - \left(\frac{1}{R_1C_3}\right)}$$

where $\omega_o$ is the center frequency in radians, and Q is the quality factor. The actual phase shift produced by this circuit in degrees is:

$$\Phi(\omega) = -2\tan^{-1}\left[\frac{\omega_o\omega\alpha}{\omega^{20} - \omega^2} - \omega^2\right] - 180 \text{ when}$$

$$\frac{\omega\omega\alpha}{\omega^{20} - \omega^2} \text{ is less than 0}$$

$$\phi(\omega) = -2\tan^{-1}\left[\frac{\omega_o\omega\alpha}{\omega^{20} - \omega^2}\right] \text{otherwise}$$

where $\omega$ is the frequency variable in radians, $\alpha$ is 1/Q, and $\omega_o$ is the center frequency.

The allpass filter as shown in FIG. 12 can be cascaded serially to produce the predetermined phase shift for approximate correction, as described earlier. When cascading, the output of the first section connects to the input of the second section and so on through the desired number of stages dependent on transducer response. Each stage can produce a maximum 360° of phase shift. The cascaded phase shift is:

$$\Phi(\omega)_{total} = \Phi(\omega)_{stage1} + \Phi(\omega)_{stage2} + \ldots \Phi(\omega)_{nth\ stage}$$

The circuit in FIG. 12 when kept below a Q of 2 produces good results for approximate correction. Amplitude non-unity of the phase correction circuit in FIG. 12, because of component tolerance, can be trimmed by tuning resistors $R_6$ or $R_7$ with a parallel high value resistor. The result will be slight center frequency shift which is insignificant with Q's of 2 or less.

Tunable Phase Correction Circuit

Tunable phase correction circuits, which are designated by functional blocks 12B, 5B in FIG. 8, provide adjustable phase corrections after gross phase errors have been compensated by fixed phase correction as above described in connection with functional blocks 12A, 5A in FIG. 8. The phase offset circuit 20 in FIG. 8 is also implemented by this kind of circuit.

Referring to FIG. 5, the allpass filter characteristic, T(s), used for tunable phase correction can be a second order bandpass filter with a bandpass transfer function:

$$T(s) = \frac{\alpha\omega s}{s^2 + \alpha\omega s + \omega^2}$$

The allpass transfer function is:

$$\frac{V_{out}}{V_\epsilon} = 2\pi(s) - 1 = \frac{S^2 - \alpha\omega s + \omega^2}{S^2 + \alpha\omega s + \omega^2}$$

The bandpass filter circuit 65 in FIG. 13 employs two operational amplifiers 67, 68 and has the same circuit structure as the tunable bandpass circuit in FIG. 11, with the equivalence of:

$$R_1=R_{10}+R_{11},\ R_7=R_{15}+R_{13}\,||\,R_{14}$$

The filter 65 has a gain $$\text{Gain}=\left(1+\frac{R_2}{R_6}\right)\left(\frac{R_{14}}{R_{13}+R_{14}}\right)$$

which is the attenuation by voltage divider $R_{13}$, $R_{14}$ multiplied by the gain of the filter. The center frequency, bandwidth (hence damping factor) are the same as for the circuit in FIG. 11, and the easiness of independent tuning of center frequency and damping factor is preserved. Just as in the case of fixed phase correction circuit, tunable phase correction circuits can be cascaded serially for wider phase correction ranges. The total phase shift is the sum of the phase shift of each stage; interaction between stages does not exist because the operational amplifier 63 works both as a summer and a buffer.

In FIG. 13, the value of resistor $R_{20}$ equals that of resistor $R_{21}$ setting an inverting unity gain for the summer 69. The gain of filter 65, which is $$\left(1+\frac{R_2}{R_6}\right)\left(\frac{R_{14}}{R_{13}+R_{14}}\right),$$

also equals unity, therefore it sets a non-inverting gain of 2 for the summer 69 because $R_{20}$ equals $R_{21}$. After summing the unity inverting gain and the non-inverting bandpass transfer function of filter circuit 65 by a gain of 2, an allpass function in accordance with FIG. 5 is produced. Resistor $R_{10}$ provides a limit of center frequency tuning by resistor $R_{11}$. Resistors $R_{13}$, $R_{14}$ provide a limit for bandwidth or damping factor tuning by variable resistor $R_{15}$. Resistor $R_{10}$ is about 4% of resistor $R_{11}$ in value. The parallel of resistors $R_{13}$ and $R_{14}$ is about 20% of resistor $R_{15}$ in value.

Power Amplifier

The power amplifier 6, 17 shown in FIG. 8 can be of any type suitable for audio use. The power amplifiers should not create errors in nonlinear phase or amplitude over the operating band of interest. The power level is of user choice but should not interfere with the measurement.

Therefore it can be seen that the above described circuits, methods and procedures provide for improved transient response in a two-way or multi-way loudspeaker system on-axis as well as over a range of off-axis angles. While the invention has been described in considerable detail in the foregoing specification, it shall be understood that it is not intended that the invention be limited to such detail except as necessitated by the following claims.

What we claim is:

1. A correction circuit for improving the transient response of a loudspeaker system having at least two transducers designated a high frequency transducer and a low frequency transducer, said correction circuit comprising a high frequency channel and a low frequency channel connectable, respectively, to the high frequency transducer and the low frequency transducer of said loudspeaker system, cross-over circuit means for dividing the frequency components of an audio input signal between said high frequency channel and low frequency channel for, respectively, driving said high frequency transducer and low frequency transducer, said cross-over circuit means having a generally defined cross-over frequency range over which both said high and low frequency transducers operate in response to an audio input signal, tunable amplitude connection circuit means for separately adjusting (i) the amplitude response characteristics of said high frequency transducer to produce a relatively flat amplitude versus frequency response therein over a substantial portion of said transducer's operating frequency range, and (ii) the amplitude characteristics of the composite amplitude response of the loudspeaker system, including the correction circuit therefor, to further produce a relatively flat amplitude versus frequency response over a substantial portion of the operating frequency range of said loudspeaker system, tunable phase correction circuit means for separately adjusting (i) the phase characteristics of said high frequency transducer to produce a phase versus frequency response therein having a relatively linear slope over a substantial portion of the operating range of said high frequency transducer, and (ii) the phase characteristics of the composite phase response of the loudspeaker system, including said correction circuit, to produce a phase versus frequency response having a relatively linear slope over a substantial portion of the operating frequency range of said loudspeaker system, and tunable phase offset circuit means for offsetting the phase of said high frequency transducer relative to the phase of said low frequency transducer over said cross-over frequency range so as to cause a forced deterioration of the composite amplitude versus frequency response of the loudspeaker system within said cross-over frequency range, said tunable phase offset circuit means including means for correcting for said deterioration of the composite amplitude versus frequency response.

2. The correction circuit of claim 1 wherein said tunable amplitude correction circuit means further includes means whereby the amplitude response characteristics of said low frequency transducer can separately be adjusted to produce a relatively flat amplitude versus frequency response over a substantially portion of said transducer's operating frequency range.

3. The correction circuit of claim 2 wherein said tunable amplitude correction circuit means is a parallel amplitude correction circuit means comprised of a tunable high frequency amplitude correction circuit operatively connected in said high frequency channel, and a tunable low frequency amplitude correction circuit operatively connected in said low frequency channel.

4. The correction circuit of claim 1 wherein the means within said tunable phase correction circuit means whereby the composite phase response of said loudspeaker system, including said phase correction circuit, can be adjusted to produce a phase versus frequency response having a relatively linear slope over a substantial portion of the operating range of said loudspeaker system, includes means for introducing frequency dependent phase delay within said cross-over frequency range.

5. The correction circuit of claim 1 wherein the means within said tunable phase correction circuit means whereby the composite phase response of said loudspeaker system, including said phase correction circuit, can be adjusted to produce a phase versus frequency response having a relatively linear slope over a substantial portion of the operating range of said loudspeaker system, includes means for adding relatively constant phase delay over a substantial portion of the operating frequency range of said high frequency transducer above said cross-over frequency range.

6. The correction circuit of claim 1 wherein the means within said tunable phase correction circuit means whereby the composite phase response of said loudspeaker system, including said phase correction circuit, can be adjusted to produce a phase versus frequency response having a relatively linear slope over a substantial portion of the operating range of said loudspeaker system, includes means for introducing frequency dependent phase delay within said cross-over frequency range and relatively constant phase delay over a substantial portion of the operating frequency range of said high frequency transducer above said cross-over frequency range.

7. The correction circuit of claim 1 wherein said cross-over circuit means provides high and low frequency roll-off characteristics of at least a third order roll-off.

8. The correction circuit of claim 7 wherein the high frequency roll-off characteristic of said cross-over circuit means is a third order roll-off and said low frequency roll-off characteristic is a fourth order roll-off.

9. The correction circuit of claim 1 wherein said cross-over circuit means has a generally defined cross-over frequency at approximately 1.4 KHz.

10. The correction circuit of claim 9 wherein said cross-over circuit means has an approximately two octave bandwidth.

11. A correction circuit for improving the transient response of a loudspeaker system having at least two transducers designated a high frequency transducer and a low frequency transducer, said correction circuit comprising (a) a high frequency channel and a low frequency channel connectable, respectively, to the high frequency transducer and the low frequency transducer of said loudspeaker system, (b) cross-over circuit means for dividing the frequency components of an audio input signal between said high frequency channel and said low frequency channel for, respectively, driving said high frequency transducer and said low frequency transducer, (c) tunable amplitude correction circuit means including, (i) a tunable low frequency amplitude correction circuit operatively connected in said low frequency channel for separately adjusting the amplitude response characteristics of said low frequency transducer to produce a relatively flat amplitude versus frequency response therein over a substantial portion of said transducer's operating frequency range, and (ii) a tunable high frequency amplitude correction circuit operatively connected in said high frequency channel for separately adjusting the amplitude response characteristics of said high frequency transducer to produce a relatively flat amplitude versus frequency response therein over a substantial portion of said transducer's operating frequency range, (iii) said tunable high and low frequency amplitude correction circuits also being tunable for further adjusting the composite amplitude response characteristics of said loudspeaker system, including said correction circuit, to produce a relatively flat amplitude versus frequency response over a substantial portion of the operating range of said loudspeaker system, (d) tunable phase correction circuit means for adjusting the phase characteristics of said high frequency transducer to produce a phase versus frequency response therein having a relatively linear slope over a substantial portion of the operating range of said high frequency transducer, and for further adjusting the phase characteristics of the composite phase response of the loudspeaker system, including said correction circuit, to produce a phase versus frequency response having a relatively linear slope over a substantial portion of the operating frequency range of said loudspeaker system, and (e) tunable phase offset circuit means for offsetting the phase of said high frequency transducer relative to the phase of said low frequency transducer over said cross-over frequency range so as to cause forced deterioration of the composite amplitude versus frequency response of the loudspeaker system within said cross-over frequency range, said tunable phase offset circuit means including means for correcting for said deterioration of the composite amplitude versus frequency response.

12. The correction circuit of claim 11 wherein the introduction of a phase offset over said cross-over frequency range by said tunable phase offset circuit means occurs in said high frequency channel, and wherein the means in said tunable phase offset circuit means for correcting for deterioration of the composite amplitude response is operatively connected to the input side of said cross-over circuit means.

13. The correction circuit of claim 12 wherein the means in said tunable phase offset circuit means for correcting for deterioration of the composite amplitude response of said loudspeaker system includes a plurality of tunable interactively connected parametric bandpass filters.

14. The correction circuit of claim 13 wherein said parametric bandpass filters each have tunable gain, frequency, and bandwidth.

15. A correction circuit for improving the transient response of a loudspeaker system having at least two transducers designated a high frequency transducer and low frequency transducer, said correction circuit comprising a high frequency channel and a low frequency channel connectable, respectively, to the high frequency transducer and the lower frequency transducer of said loudspeaker system, cross-over circuit means for dividing the frequency components of an audio input signal between said high frequency channel and low frequency channel for, respectively, driving said high frequency transducer and low frequency transducer, said cross-over circuit means having a generally defined cross-over frequency range over which both said high and low frequency transducers operate in response to an audio input signal, circuit means for correcting the amplitude and phase characteristics of said loudspeaker system, including said correction circuit, to produce an amplitude versus frequency response which is relatively flat over a substantial portion of the operating frequency range thereof, and a phase versus frequency response which has a relatively linear slope over a substantial portion of the operating frequency range thereof, and tunable phase offset circuit means for offsetting the phase of said high frequency transducer relative to the phase of said low frequency transducer over said cross-over frequency range so as to cause a forced deterioration of the composite amplitude versus frequency response of the loudspeaker system within said cross-over frequency range, said tunable phase offset circuit means including means for correcting for said deterioration of the composite amplitude versus frequency response.

16. The correction circuit of claim 15 wherein the introduction of a phase offset over said cross-over frequency range by said tunable phase offset circuit means occurs in said high frequency channel, and wherein the means in said tunable phase offset means for correcting for deterioration of the composite amplitude response of said loudspeaker system is operatively connected to the input side of said cross-over circuit means.

17. The correction circuit of claim 16 wherein said means in said tunable phase offset means for correcting for deterioration of the composite amplitude response of said loudspeaker system includes a plurality of tunable interactively connected parametric bandpass filters.

18. The correction circuit of claim 17 wherein said parametric filters each have tunable gain, frequency, and bandwidth.

19. A method for improving the transient response of a loudspeaker system having at least two transducers designated a high frequency transducer and a low frequency transducer and having a cross-over frequency range overlapping the operating frequency ranges of said high and low frequency transducers, said method comprising the steps of (a) separately measuring the amplitude response characteristics of said high frequency transducer, (b) separately adjusting the amplitude response characteristics of said high frequency transducer to produce a relatively flat amplitude versus frequency response therein over a substantial portion of the operating range of said high frequency transducer, (c) separately measuring the phase characteristics of said high frequency at the measurement transducer, (d) separately adjusting the phase characteristics of said high frequency transducer to produce a phase versus frequency response therein having a relatively linear slope over a substantial portion of the operating range of said high frequency transducer, (e) measuring the composite amplitude response characteristics for said loudspeaker system, including said correction circuit, (f) adjusting the composite amplitude response characteristics of said loudspeaker system, including the correction circuitry associated therewith, to produce a relatively flat amplitude versus frequency response therein over a substantial portion of the operating frequency range of said loudspeaker system, (g) measuring the composite phase characteristics of said loudspeaker system, including the correction circuitry associated therewith.

(h) adjusting the composite phase response characteristics of the loudspeaker system, including the correction circuitry associated therewith, to produce phase versus frequency response therein having a relatively linear slope over a substantial portion of the operating frequency range of said loudspeaker system, (i) offsetting the phase of said high frequency transducer relative to said low frequency transducer within the loudspeaker system's cross-over frequency range so as to cause a forced frequency response deterioration within said cross-over frequency range, (j) measuring the deterioration of the composite amplitude response characteristics in said loudspeaker system, including said correction circuit, as compared to a relatively flat amplitude versus frequency response, and (k) correcting for the deterioration in said composite amplitude response characteristics of the loudspeaker system resulting from the phase offset introduced in the foregoing step (i).

20. The method of claim 19 wherein steps (e) through (h) involving measuring and adjusting the composite amplitude and composite phase responses of said loudspeaker system are performed iteratively until a satisfactory composite amplitude and phase response is achieved.

21. The method of claim 19 further including, before adjusting composite amplitude and phase responses, the steps of separately measuring the amplitude response of said low frequency transducer, and separately adjusting the amplitude response characteristics thereof to produce a relatively flat amplitude versus frequency response therein over a substantial portion of said transducer's operating frequency range.

22. The method of claim 19 wherein the step of adjusting the composite phase characteristics of said loudspeaker system include introducing frequency dependent phase delay to said loudspeaker system within said cross-over frequency region to adjust for phase non-linearities within said cross-over frequency region, and adding substantially constant phase delay in the operating frequency range of said high frequency transducer above said cross-over frequency region.

23. The method of claim 19 wherein the amplitude and phase response characteristics of the high frequency transducer and the composite amplitude and phase response characteristics of said loudspeaker system are measured at a measurement point on axis with said high frequency transducer.

24. The method of claim 23 wherein said measurement point is approximately one-half meter from said high frequency transducer.

25. The method of claim 19 wherein the step of offsetting the phase of said high frequency transducer relative to said low frequency transducer includes introducing frequency dependent phase shift in the cross-over frequency range, observing the composite amplitude response of the loudspeaker system at different points in space over different vertical angles in front of the loudspeaker system, and adjusting the amount of phase shift until the system's composite amplitude response at the different observation points is substantially the same.

26. A correction circuit for improving the transient response of a loudspeaker system having at lest two transducers designated a high frequency transducer and a low frequency transducer, said correction circuit comprising a high frequency channel and a low frequency channel connectable, respectively, to the high frequency transducer and the low frequency transducer of said loudspeaker system, cross-over circuit means for dividing the frequency components of an audio input signal between said high frequency channel and low frequency channel for, respectively, driving said high frequency transducer and low frequency transducer, said cross-over circuit means having a generally defined cross-over frequency range over which both said high and low frequency transducers operate in response to an audio input signal, tunable phase offset circuit means for offsetting the phase of said high frequency transducer relative to the phase of said low frequency transducer so as to cause a forced deterioration of the composite amplitude versus frequency response of the loudspeaker system within the cross-over frequency range, means on the input side of said cross-over circuit for correcting for said deterioration of the composite amplitude versus frequency response after offsetting the phase of said high frequency transducer relative to said low frequency transducers.

* * * * *